United States Patent [19]

Finnegan

[11] Patent Number: 4,832,208

[45] Date of Patent: May 23, 1989

[54] STORAGE RACK

[76] Inventor: Richard J. H. Finnegan, 12 Vale Crescent, Ajax, Ontario, Canada

[21] Appl. No.: 125,128

[22] Filed: Nov. 25, 1987

[30] Foreign Application Priority Data

Nov. 28, 1986 [CA] Canada ..... 524136

[51] Int. Cl.[4] ..... A47F 7/00

[52] U.S. Cl. ..... 211/73; 211/72; 211/74; 206/564

[58] Field of Search ..... 211/72, 73, 71, 74, 211/75, 70.1, 60.1, 10; 206/564, 557; 99/441, 426

[56] References Cited

U.S. PATENT DOCUMENTS

| | | | |
|---|---|---|---|
| 162,827 | 5/1875 | Kinney | 211/72 X |
| 3,200,957 | 8/1965 | Morin | 211/71 X |
| 3,272,371 | 9/1966 | Weiner | 206/564 X |
| 3,591,032 | 7/1971 | Baxter | 206/564 X |
| 4,004,501 | 1/1977 | Guerrero | 99/426 |
| 4,207,979 | 6/1980 | Brown | 206/564 X |
| 4,350,253 | 9/1982 | Rusteberg | 211/74 |
| 4,378,889 | 4/1983 | Lebowitz | 211/74 X |

OTHER PUBLICATIONS

Kitchen–Bath Business Magazine, Sep., 1987, advertisement for Spice Tray Trim–Fit, Vance Industries, Chicago.

*Primary Examiner*—Robert W. Gibson, Jr.
*Attorney, Agent, or Firm*—Ivor M. Hughes

[57] ABSTRACT

A storage rack comprising a unitary sheet of thermoplastic material extending generally in a horizontal plane in use suitable for insertion within a compatibly shaped horizontal compartment; the rack having a top, bottom, front rear and plurality of sides, having at least one recess formed therein extending from its top, said at least one recess extending towards the bottom of the rack; said at least one recess consisting of a plurality of angularly stepped portions for supporting articles at an incline to the horizontal; the storage rack carrying upon its top surrounding the at least one recess, at least one trimmable flange extending in a plane laterally away from the recess to allow for variation in the dimensions of similarly sized compartments.

17 Claims, 5 Drawing Sheets

STORAGE RACK

FIELD OF INVENTION

This invention relates to storage racks and more particularly those found within a drawer.

BACKGROUND OF INVENTION

Many storage racks for a multiplicity of uses made from a wide variety of materials exist. Some of these racks are simple in construction while others are more complex. Some are constructed of metal or wood, while with today's economic pressures those formed from plastic and cardboard are considered a better value. The substance of this invention is to provide a unique storage rack which for example fits in a drawer which securely supports a multiplicity of items in an organized array and the contents thereof is made available to the user simply by opening the drawer.

U.S. Pat. No. 1,610,834 (M. L. Webster patentee) teaches a container dispensing rack disposed vertically for display purposes, having individual compartments for each container.

U.S. Pat. No. 4,228,904 (V. Dumond patentee) teaches a display rack for counter tops having a vertically stepped format comprising multiple components, having a slotted inclined member wherein supporting pockets are arranged.

U.S. Pat. No. 3,895,720 (C. D. Presberg patentee) teaches a modular section combining to form racks to receive flat articles in a systematic manner, being interconnected by tongue and groove joints, each section being preferably cut to required lengths.

U.S. Pat. No. 4,182,455 (A. Zurawin patentee) teaches a hollow molded rack for displaying and dispensing containers; the rack being modular and being formed from a unitary plastic sheet, and sustaining the container generally horizontally.

U.S. Pat. No. 4,398,638 (D. E. Racine patentee) teaches a storage rack for holding spools. U.S. Pat. No. 4,064,992 (Ralston et al Patentee) teaches a spacesaver tiltable storage unit. U.S. Pat. No. 4,192,439 teaches a spice rack.

U.S. Pat. No. 4,378,889 (S. Lebowitz patentee) teaches a spice rack and bracket assembly, each molded from a single sheet of plastic material adapted to hold an array of bottles, which can be mounted on a wall, stood on a counter, or to lie flat on a counter, having a staircase frame having rows of semicircular notches coincident with semicircular wells.

U.S. Pat. No. 3,774,774 (G. G. Menkel patentee) teaches an article display stand having a first plate which is stepped in structure, said first plate being secured to a second plate, and having semicircular notches for receiving and securing a container.

To applicant's best understanding none of the prior art reviewed was specifically intended to be installed within a drawer. However applicant is aware of Rubbermaid Inc. (located in Wooster, Ohio, U.S.A.) which manufactures and sells cutlery trays and assorted other trays which are used primarily in a drawer.

Further Applicant is aware of Vance Industries Trademark "Trim-Fit" referring generally to Drawer Organizers, who offer in the U.S. market a cutlery tray having trimmable flanges for insertion within a drawer. A European Manufacturer unknown to Applicant has a registered trademark "Elco" stamped upon a cutlery tray with trimmable flanges.

Applicant is also aware of wooden structures manufactured to the size of each standard drawer found in kitchens which generally are inserted in the drawer and are used as spice racks but are much more expensive to manufacture and lack the novelty of being adjustable on sight. Should the purchaser have a non standard drawer size or even a slight variation from standard, the wooden unit could not be installed in a drawer without significant alteration to either the drawer or the rack or both.

However applicant's invention goes beyond any of the prior art cited in that he provides an angularly stepped storage rack suitable for inserting in a drawer made from a unitary sheet of thermoplastics material and having trimmable flanges formed during, for example vacuum molding, upon which the rack generally rests within a drawer, said rack being adjustable to the drawer length and width. None of the aforementioned racks or trays offer this unique combination of economy and flexibility in a stepped storage rack.

It is therefore an object of this invention to provide a stepped storage rack suitable for insertion within a drawer.

It is a further object of this invention that the rack size may be altered to the drawer dimensions by an installer.

It is a further object of this invention to vacuum form the storage rack from a single sheet of thermoplastics material.

It is still a further object of the invention to systematically display and organize various containers and articles within a drawer.

Further and other objects of this invention will the following summary of the invention and the more detailed embodiments of the invention illustrated herein.

SUMMARY OF THE INVENTION

According to one aspect of the invention a storage rack is provided, the rack comprising a unitary sheet of thermoplastic material extending generally in a horizontal plane in use suitable for insertion within a compatibly shaped horizontal compartment (such as a drawer in a preferred embodiment); the rack having a top, and bottom, having at least one recess formed therein extending from its top, said at least one recess extending towards the bottom of the rack; wherein at least one of said at least one recesses consists of a plurality of angularly stepped portions for supporting articles at an incline to the horizontal, for example, the supporting surfaces being angled at substantially 90 degrees to one another; the storage rack carrying upon its top surrounding the at least one recess, at least one trimmable flange extending in plane laterally away from the at least one recess to allow for variation in the dimensions of similarly sized horizontal compartments.

According to another aspect of the invention a storage rack is provided, the rack comprising a unitary sheet of thermoplastic material for being positioned to extend generally in a horizontal plane in use suitable for insertion in a drawer, the rack having a top, bottom, front, rear, and sides, and having at least one recess formed therein, wherein at least one of said at least one recesses provides a plurality of angularly stepped portions formed upon its bottom for supporting articles at an incline to the horizontal; the rack carrying upon its top surrounding the at least one recess, at least one peripheral trimmable flange extending in a plane laterally away from said at least one recess and being trimmable by an installer allowing for variation in the dimensions of similarly sized drawers; preferably said stepped portions beginning at the top of the rack at the front thereof and extending uniformly towards the rear in a multiplicity of steps within one of said at least one recesses comprising alternating angled upwardly and angled downwardly extending planes, said planes also extending from side to side, preferably said multiplicity of steps commencing proximate the front away from proximate said front towards the bottom of the rack and terminating thereat, then extending angularly upwardly away from the bottom of the rack towards the top therefrom continuing angularly downwardly away from said top towards the bottom of the rack, thereafter repeating the stepped formation to provide continuous stepping from front to rear of the at least one recess until the last upward plane extends fully to the top rear of the rack; preferably the angularly downwardly-extending planes of each step are generally shorter in extension than the angularly upwardly extending planes thereof, and preferably, the supporting surfaces of the angularly upwardly and angularly downwardly extending planes being separated by about 90 degrees; whereby the rack rests upon its bottom in a drawer or upon its peripheral flanges upon portions of a drawer.

According to yet another aspect of the invention a spice rack suitable for insertion within a drawer is provided, said spice rack comprising a unitary sheet of thermoplastic material having a top, bottom, front, rear, and two sides and having a central recess formed therein upon its top, extending towards the bottom of the spice rack, said central recess consisting of a plurality of stepped portions for supporting spice bottles at an incline to the horizontal; said spice rack carrying at least one, and preferably four, peripheral trimmable flanges surrounding said central recess said at least one flange extending laterally away from said spice rack, enabling an installer to trim the flanges prior to installation within a drawer, thereby allowing for variation in the construction of said drawer in which the spice rack is to be installed.

According to another aspect of the invention, an angularly stepped storage rack suitable for inserting in a drawer is provided, the rack made from a unitary sheet of thermoplastics material and having trimmable flanges surrounding an angularly stepped storage portion.

According to another aspect of the invention in a preferred embodiment thereof the storage rack is vacuum formed; but may be manufactured by an other suitable alternative method.

DETAILED DESCRIPTION ON THE DRAWINGS

Referring to FIGS. 1, 2, 3, and 4 spice rack "S" is illustrated extending primarily horizontally, said rack having a top, bottom, front, rear and two sides and is formed by known vacuum forming methods requiring the establishment of a mold die from which all racks are manufactured. It is however conceivable that any alternative form of manufacture could be used to arrive at the instant invention.

Figure 1:
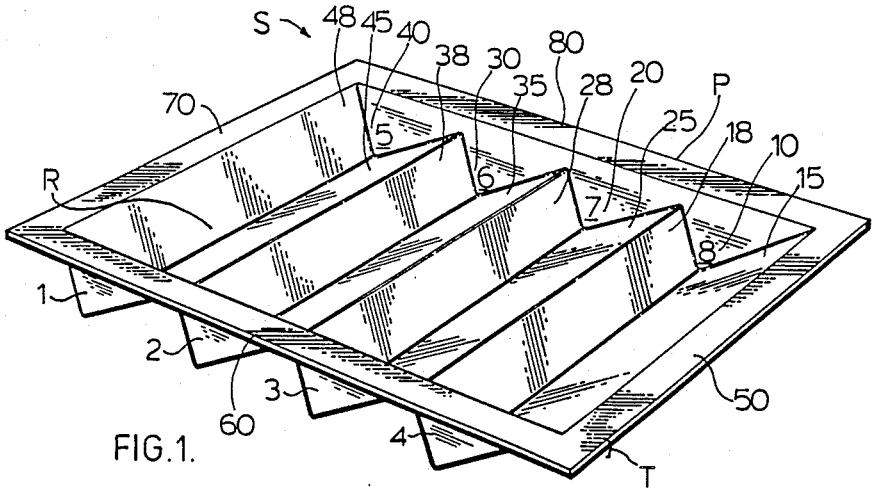
FIG. 1 is a perspective view of a spice rack inclined horizontally suitable for insertion within a drawer in a preferred embodiment of the invention.
Figure 2:
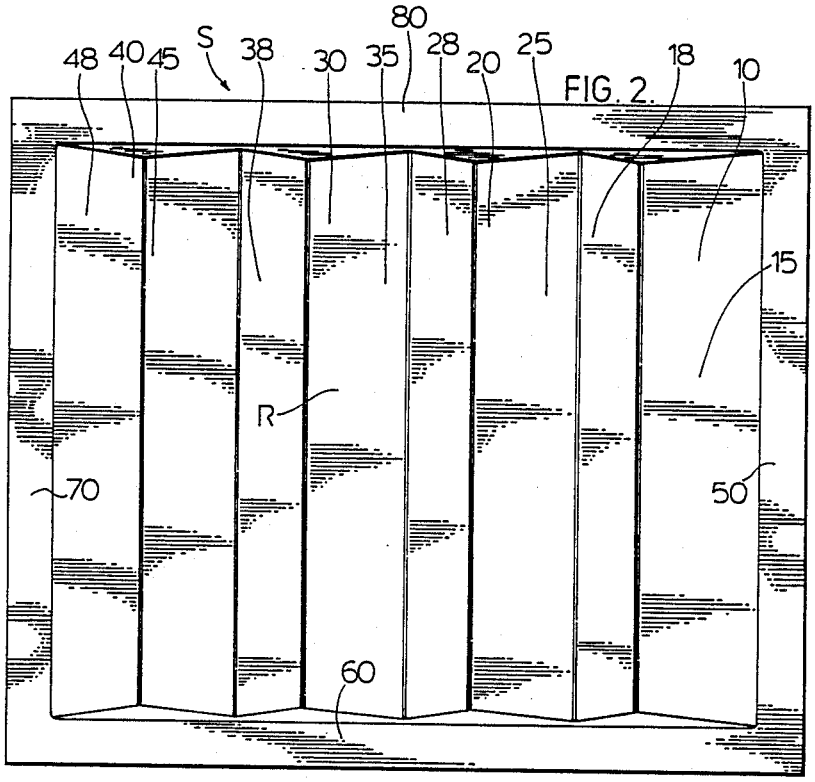
FIG. 2 is a top view of the spice rack of FIG. 1 in a preferred embodiment of the invention.
Figure 1A:
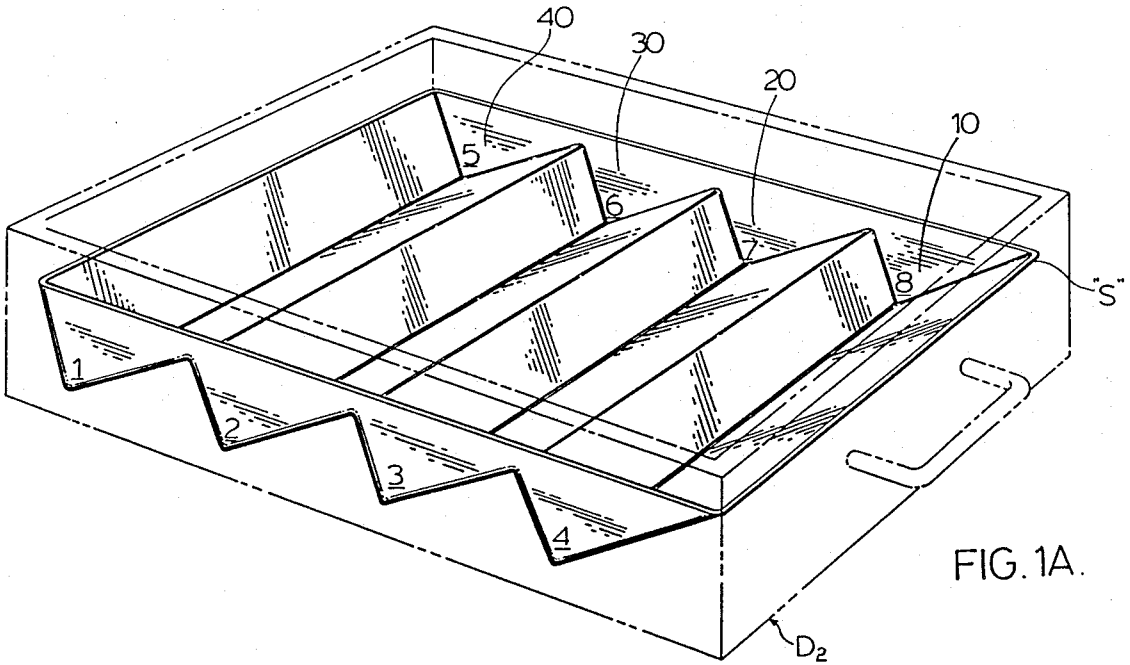
FIG. 1A is a perspective view of the spice rack of FIG. 1 resting upon the bottom of a drawer in a preferred embodiment of the invention.
Figure 1B:
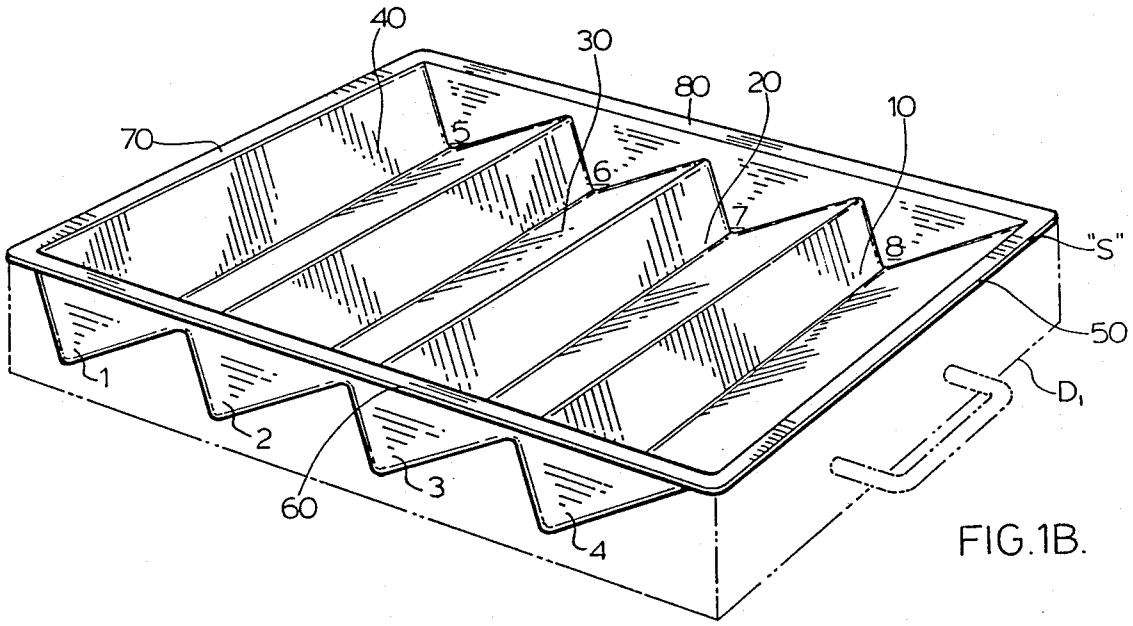
FIG. 1B is a perspective view of the spice rack of FIG. 1 resting upon its peripheral flanges upon the top side edges of a drawer in a preferred embodiment of the invention.

The spice rack "S" is formed therefore from a unitary sheet of thermoplastics material "P" of thickness "T" extending horizontally in use having a centrally disposed recess "R" within which stepped portions 10, 20, 30, and 40 are contained. The centrally disposed recess "R" is circumscribed by peripheral trimmable flanges 50, 60, 70, and 80 at the front, rear and two sides thereof, said flanges extending laterally away from said spice rack "S" generally in a horizontal direction, each flange having sufficient width to allow trimming of a calculated amount of the flange by an installer to accurately fit the spice rack "S" within a drawer as illustrated in FIGS. 1A and 1B. FIG. 1A illustrates spice rack "S" inserted within a drawer $D_1$ wherein because of the drawer's tight dimensions, flanges 50, 60, 70, and 80 have been almost totally trimmed, allowing the spice rack to snuggly fit within the drawer resting on the bottom thereof. It is however recommended that the spice rack be installed within drawer $D_2$ of FIG. 1B as shown wherein flanges 50, 60, 70, and 80 have been trimmed in width to snuggly fit in use over the side panels 500 of and front and rear panels 600 of a drawer at the top edges thereof such that the rack will not bind when drawer $D_2$ is slid in and out upon its mounting.

Figure 3:
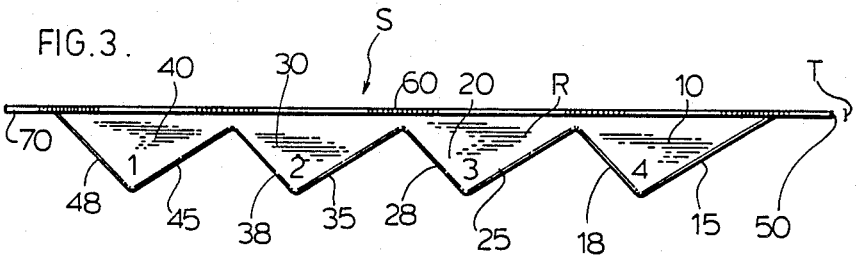
FIG. 3 is a side view of the spice rack of FIG. 1 in a preferred embodiment of the invention.
Figure 4:
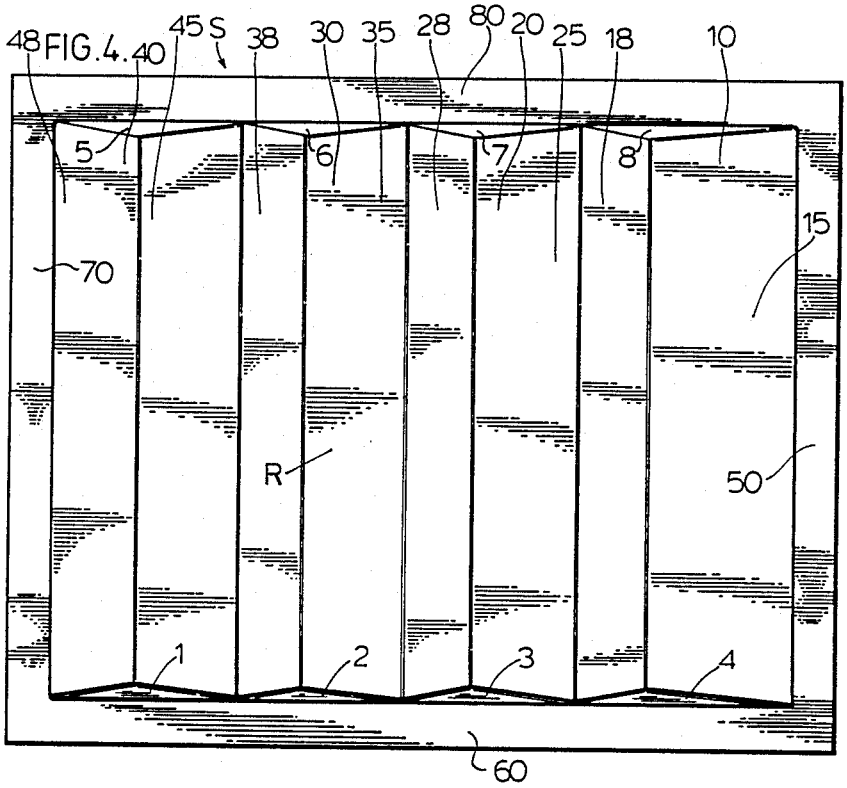
FIG. 4 is a bottom view of the spice rack of FIG. 1 in a preferred embodiment of the invention.

As best illustrated in FIG. 3 stepped portions 10, 20, 30, 40 are formed with the recess "R" of spice rack "S" upon the bottom thereof, commencing at the front flange 50 and extending angularly downwardly away from said front flange 50 along segment 15 towards the bottom of the rack and terminating thereat at the union of segments 15 and 18, then extending angularly upwardly away from said union towards the top of the rack along segment 18 terminating proximate the top of the rack at the union of segments 18 and 25, then extending angularly downwardly away from the union of segments 18 and 25 along segment 25 towards the bottom of the rack and terminating thereat at the union of segments 25 and 28, then extending angularly upwardly away from said union towards the top of the rack along segment 28 terminating proximate the top of the rack at the union of segments 28 and 35, then extending angularly downwardly away from said union along segment 35 towards the bottom of the rack and terminating thereat at the union of segments 35 and 38, then extending angularly upwardly away from said union towards the top of the rack along segment 38 terminating proximate the top of the rack at the union of segments 38 and 45, then extending angularly downwardly away from said union along segment 45 towards the bottom of the rack and terminating thereat at the union of segments 45 and 48, then extending angularly upwardly away from said union towards the top of the rack along segment 48 which extends fully to the top rear of said rack and thereat joins the rearward trimmable flange 70.

Stepped portions 10, 20, 30, and 40 begin at the top of the rack at the front thereof in four steps within recess "R" comprising alternating angled upwardly (18, 28, 38, and 48) and angled downwardly (15, 25, 35, 45) extending planes, said planes also extending from side to side between the side flanges 60 and 80. The angularly downwardly extending segments 15, 25, 35, and 45 are shorter in extension from the angularly upwardly extending planes thereof 18, 28, 38, and 48 in order to attractively and the bottom of spice rack "S". Further, the angle between the downwardly extending segments and the angled upwardly extending segments is about 90 degrees.

Downwardly extending triangular segments 1, 2, 3, 4, 5, 6, 7, and 8 border on the side of central recess "R" adjacent each flange 60 and 80 and define the extreme sideways extensions of corresponding stepped portions 10, 20, 30, and 40.

The thermoplastics material "P", used to vacuum form spice rack "S", is of suitable thickness "T" to allow for a smooth uniform finish with no cracks or breaks in any surfaces, after vacuum forming of said rack, and the resulting deformation, stretching, and creeping of materials "P".

Figure 5:
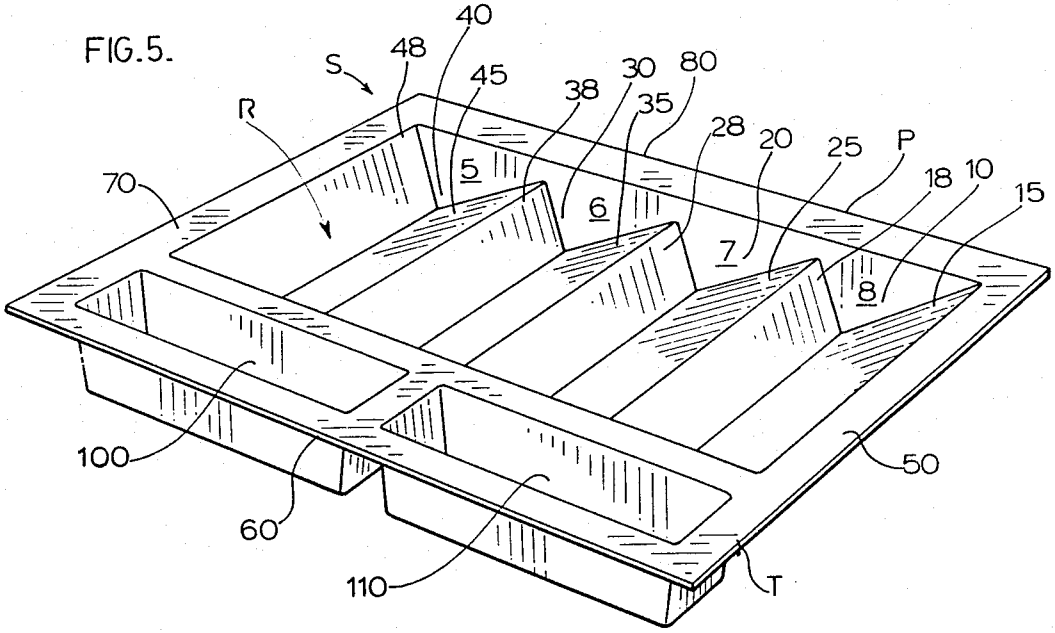
FIG. 5 is a perspective view of the spice rack in an alternative embodiment of the invention.

In another example the storage rack includes cutlery tray portions incorporated into the unit with a stepped portion adjacent thereto. Referring now to FIG. 5 an alternative embodiment of the spice rack is illustrated being similar to FIG. 1 but including portions 100 and user to store for example cutlery, buttons, etc., within the same tray. Of course more or less than two portions may be formed in further alternatives of varying lengths and widths without departing from the scope of the invention, the embodiment of FIG. 5 being included as an example only and is not to be considered limiting in any way.

As many changes can be made to the preferred and alternative embodiments of the invention without departing from the scope of the invention; it is intended that all matter contained herein be interpreted as illustrative of the invention and not in a limiting sense.

The embodiments of the invention in which an exclusive property or privilege is claimed are as follows:

1. A storage rack comprising a unitary sheet of thermoplastic material extending generally in a horizontal plane in use suitable for insertion within a compatibly shaped horizontal compartment; the rack having a top, and bottom, having at least one recess formed therein extending from its top, said at least one recess extending towards the bottom of the rack; wherein a least one of said at least one recesses consists of a plurality of angularly stepped portions for supporting articles at an incline to the horizontal; the storage rack carrying upon its top surrounding the at least one recess, at least one trimmable flange extending in a plane laterally away from the recess to allow for variation in the dimensions of similarly sized compartments.

2. The storage rack of claim 1, wherein the supporting surfaces of the stepped portions are angled at substantially 90 degrees to one another.

3. A storage rack comprising a unitary sheet of thermoplastic material for being positioned to extend generally in a horizontal plane in use suitable for insertion in a drawer; the rack having a top, bottom, front, rear, and sides, and having at least one recess formed therein, wherein at least one of said at least one recesses provides a plurality of angularly stepped portions formed upon its bottom for supporting articles at an incline to the horizontal, and carrying upon its tip surrounding the at least one recess, at least one peripheral trimmable flange extending in a plane laterally away from said at least one recess and being trimmable by an installer allowing for variation in the dimension of similarly sized drawers; whereby the rack rests upon its bottom in a drawer or upon its peripheral flanges upon portions of a drawer.

4. The storage rack of claim 3 , wherein said stepped portions beginning at the top of the rack at the front thereof and extending uniformly towards the rear in a multiplicity of steps within one of said at least one recesses comprising alternating angled upwardly and angled downwardly extending planes, said planes also extending from side to side.

5. The storage rack of claim 3, wherein said multiplicity of steps commences proximate the front of the storage rack and extending angularly downwardly away from proximate said front towards the bottom of the rack and terminating thereat, then extending angularly upwardly away from the bottom of the rack towards the top thereof terminating proximate the top thereof and therefrom continuing angularly downwardly away from said top towards the bottom of the rack, thereafter repeating the stepped formation to provide continuous stepping from front to rear of the at least one recess until the last upward plane extends fully to the top rear of the rack.

6. The storage rack of claim 4, wherein said multiplicity of steps commences proximate the front of the storage rack and extending angularly downwardly away from proximate said front towards the bottom of the rack and terminating thereat, then extending angularly upwardly away from the bottom of the rack towards the top thereof terminating proximate the top thereof and therefrom continuing angularly downwardly away from said top towards the bottom of the rack, thereafter repeating the stepped formation to provide continuous stepping from front to rear of the at least one recess until the last upward plane extends fully to the top rear of the rack.

7. The rack of claim 4, wherein the angularly downward extending planes of each step are generally shorter in extension than the angularly upwardly extending planes thereof.

8. The rack of claim 5, wherein the angularly downward extending planes of each step are generally shorter in extension than the angularly upwardly extending planes thereof.

9. The rack of claim 4, wherein the supporting surfaces of the angularly upwardly and angularly downwardly extending planes are separated by about 90 degrees.

10. The rack of claim 5, wherein the supporting surfaces of the angularly upwardly and angularly downwardly extending planes are separated by about 90 degrees.

11. The rack of claim 7, wherein the supporting surfaces of the angularly upwardly and angularly downwardly extending planes are separated by about 90 degrees.

12. A spice rack suitable for insertion within a drawer comprising a unitary sheet of thermoplastic material having a top, bottom, front, rear, and two sides and having a central recess formed therein upon its top, extending towards the bottom of the spice rack, said central recess consisting of a plurality of stepped portions for supporting spice bottles at an incline to the horizontal, and carrying four peripheral trimmable flanges surrounding said central recess, said flanges extending laterally away from said spice rack, enabling an installer to trim the flanges prior to installation within a drawer, thereby allowing for variation in the construction of said drawer in which the spice rack is to be installed.

13. A spice rack suitable for insertion within a drawer comprising a unitary sheet of thermoplastic material having a top, bottom, front, rear, and two sides and having a central recess formed therein upon its top, extending towards the bottom of the spice rack, said central recess consisting of a plurality of stepped portions for supporting spice bottles at an incline to the horizontal, and carrying at least one peripheral trimmable flange surrounding said central recess, said at least one flange extending laterally away from said spice rack, enabling an installer to trim the at least one flange prior to installation within a drawer, thereby allowing for variation in the construction of said drawer in which the spice rack is to be installed.

14. The storage rack of claim 1, wherein the storage rack is vacuum formed.

15. The storage rack of claim 3, wherein the storage rack is vacuum formed.

16. The storage rack of claim 12, wherein the storage rack is vacuum formed.

17. The storage rack of claim 13, wherein the storage rack is vacuum formed.

* * * * *